US006009590A

United States Patent [19]

Stanford

[11] Patent Number: 6,009,590

[45] Date of Patent: Jan. 4, 2000

[54] LOTTERY TICKET SCRAPER INCORPORATING COIN

[76] Inventor: Kirk M Stanford, 68 Avon St., Somerville, Mass. 02143

[21] Appl. No.: 09/139,169

[22] Filed: Aug. 24, 1998

[51] Int. Cl.[7] ..... A47L 13/02

[52] U.S. Cl. ..... 15/236.07; 15/236.01; D3/211; D32/42; D32/43; D32/46

[58] Field of Search ..... 15/236.01, 236.07; D3/207, 208, 210, 211; D32/42, 43, 46; 206/81

[56] References Cited

U.S. PATENT DOCUMENTS

| | | | |
|---|---|---|---|
| D. 159,278 | 7/1950 | Leland | D3/208 |
| D. 386,856 | 11/1997 | Cefalu | D32/46 |
| D. 400,326 | 10/1998 | Fisher | D3/208 |
| 2,537,598 | 1/1951 | Mason . | |
| 5,027,512 | 7/1991 | Andrews | 15/236.01 |
| 5,615,441 | 4/1997 | Savini | 15/236.07 |
| 5,884,513 | 3/1999 | Norris | D3/208 |

*Primary Examiner*—Randall E. Chin
*Attorney, Agent, or Firm*—Mark P. White

[57] ABSTRACT

A lottery ticket scraper incorporates a coin as the scraping surface. The scraper includes a body having a modified teardrop shape, with a major and minor end, the minor end having a reduced thickness to incorporate a key-ring hole, allowing keys to be added without binding or expanding to an undesired size. The body further includes a depression to allow the user to comfortably grasp the scratcher and use it to remove the protective film of the lottery ticket without strain or discomfort to the user's hand. The scraper includes a recess in the major end of the body into which a coin may be glued or press-fit. The recess is so formed as to allow the coin to be reliably captured therein, while still providing sufficient overhang to allow the edge of the coin to be applied to the lottery ticket surface.

4 Claims, 2 Drawing Sheets

LOTTERY TICKET SCRAPER INCORPORATING COIN

FIELD OF THE INVENTION

This invention relates to scraping devices generally, and more specifically, this invention relates to a hand held device enabling the surface of a lottery ticket to be removed by incorporating a coin into the body of the device.

BACKGROUND OF THE INVENTION

Instant lottery tickets have become common place in modern American society. Instant lottery tickets, which have come to be referred to as scratch tickets, can be purchased at convenience stores, gas stations, markets, and almost anywhere else where peoples shop on a daily basis.

These "scratch tickets" are so called because they are covered with a layer, or layers, of opaque materials which hide text printed on the surface of the ticket which tells the player whether or not he or she has won. The surface is scratched off by the player in a variety of ways, including fingernails, knives, and coins. The surface layers are generally of such a nature that they yield to such methods of removal.

Independent lottery stores have not been established or have been unsuccessful, possibly due to the fact that many scratch ticket sales are made on impulse. The average consumer does not shop with the intention of purchasing scratch tickets, but rather purchases lottery tickets as an afterthought when he or she reaches the cashier.

Most people do not consider themselves serious participants in the scratch card industry; they view themselves as casual partakers interested in the game more than profit. The operators of the lottery try to sell the idea that most people would like to win untold fortunes, but the purchaser often does not regard the purchase of a lottery ticket as a legitimate investment. Because of the foregoing, an investment in time or money in the activity of playing the lottery is unlikely, aside from the expenditure on lottery tickets. It is because of this fact that many worthy inventions have not supplanted the use of the coin as the primary utensil used to scratch the film off of instant lottery tickets.

The coin is actually well suited as a lottery ticket scraper. The combination of the hard metal surface and the serrated edge provides an efficacious way to remove the surface layer of the lottery ticket.

Furthermore, most users view many of the inventions available to remove the surface layer of the ticket as complex or "gadgety". Many lottery players apparently feel their money would be ill spent on another gadget that might disappoint by its lack of execution, especially when a coin, generally available to everyone, works so well.

Beside the ready availability of the coin and its efficacy as a scratching mechanism, there are other aspects of the coin that make it a favorite among lottery players. Coins have long been revered as lucky or mystical. Some people feel an affinity to coins minted in the year of their birth. Then there is the old adage, "Find a penny pick it up and all day long you'll have good luck". The large number of coin collectors also testifies to the interest coins have generated through the years.

All of the above factors contribute to the popularity of coins as a means to scratch lottery tickets.

The only disadvantage of the coin as a lottery tickets scratcher is the limited surface area it provides the user to grasp. Because of the size of the average coin, it must be held between the thumb and the forefinger. While the amount of pressure needed to scratch a lottery ticket is not great it, gripping the coin in this way is awkward, and may cause certain parts of the hand to become fatigued, especially since the pressure must be channeled through the limited area used to grasp the coin. If the pressure could be more evenly distributed over a larger surface, and throughout the hand, this discomfort could be avoided.

The present invention solves the aforementioned problems with a compact, lightweight, cost-effective scratcher that allows the lottery player to scratch in comfort, while doing so in a pleasing and efficient manor. It does so while continuing to allow the player to utilize the various characteristics of the coin, which has been heretofore preferred for this purpose.

SUMMARY OF THE INVENTION

A general object of the current invention is to provide a simple, low cost, lottery ticket scraper. A specific object of the current invention is to incorporate a coin into said scraper to act as the scraping edge.

An still further specific object of the current invention is to provide such a scraper that allows a user to use his/her own coin.

According to another aspect of the invention the shape of the scraper body is a modified teardrop, with the smaller end made square, to aid in the comfort level of the user.

According to still another aspect of the invention the underside has a depression for the placement of the thumb.

According to a final aspect of the invention the square end of the body has a hole with a key ring placed therethrough.

DETAILED DESCRIPTION OF THE PREFERRED EMBODIMENTS

Figure 1:
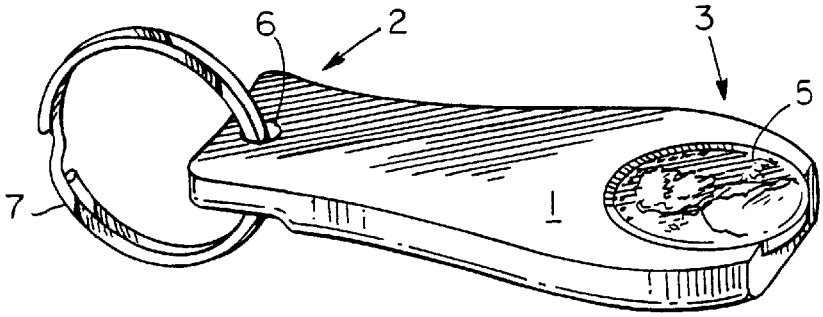
FIG. 1 depicts a perspective view of the Lottery Ticket Scraper Incorporating Coin.
Figure 5:
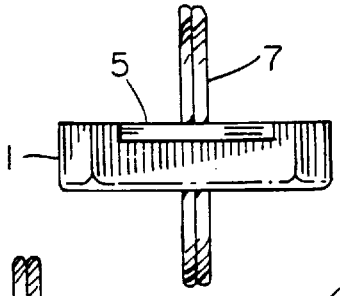
FIG. 5 depicts a front elevation view of the Scraper.

The preferred embodiments may be understood by first referring to FIG. 1, which depicts a perspective view of the Lottery Ticket scraper Incorporating Coin.

Figure 6:
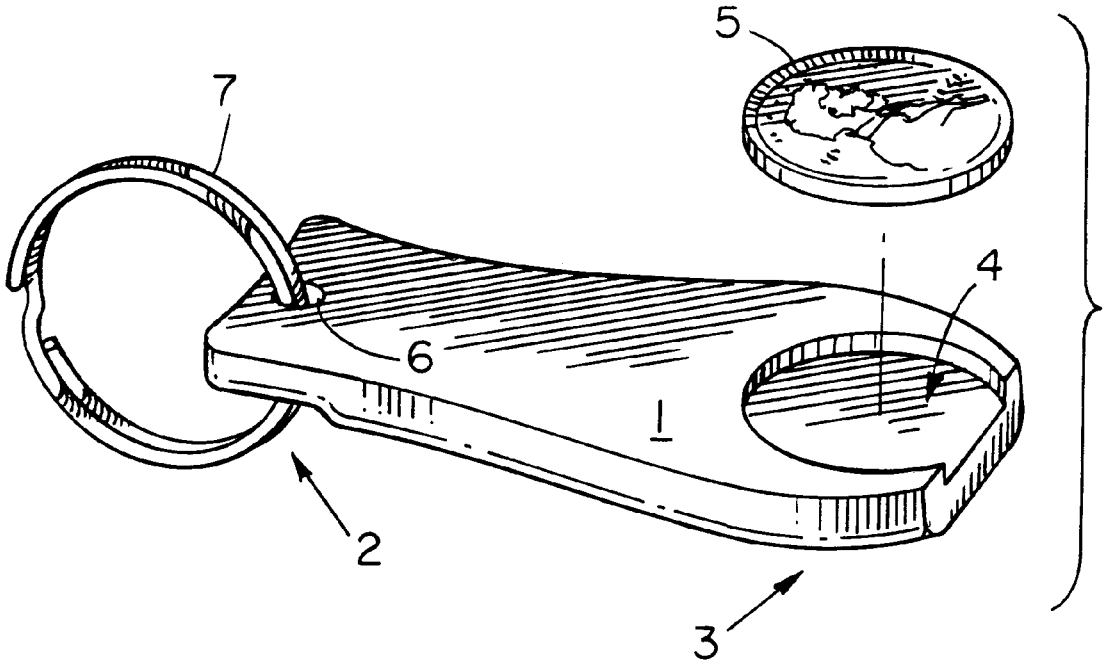
FIG. 6 depicts a perspective view of the Lottery Ticket Scraper, with the coin removed, revealing the recess.

In the drawing of FIG. 1, the scraper comprises the body 1, a minor end 2, a major end 3, a recess 4 located on the major end in which a coin 5 has been placed. The coin placed in the recess overhangs the edge of the body and is essential to the proper working of the scraper. A key ring hole 6 is present on the minor end with a key ring 7 inserted through the key ring hole. FIG. 6 depicts a perspective view similar to FIG. 1, but with the coin removed from the recess.

The modified teardrop shape of the body is that of a modified teardrop with a square minor end. The modified teardrop shape is not essential to the design of the scraper but is rather an ergonomic design to comfort the user.

Figure 2:
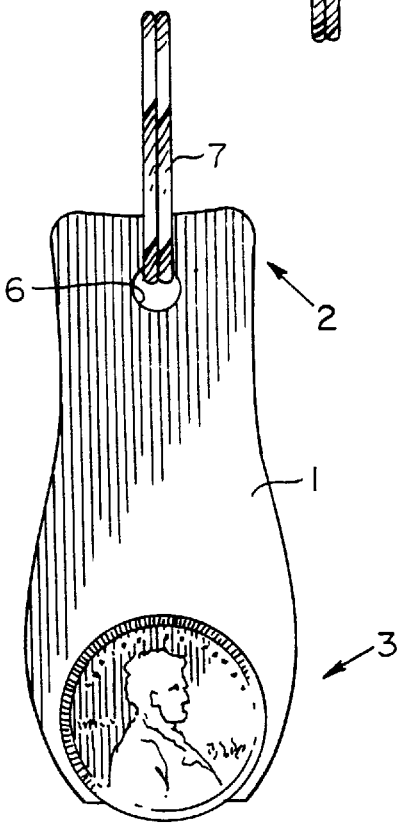
FIG. 2 depicts a top plan view of the Scraper.

FIG. 2 depicts a top plan view of the Scraper, showing the coin inserted into the recess. The amount of the coin which is exposed is ultimately determined by the shape of the recess in which the coin is placed. The recess is circularlyshaped when viewed in plan view, and is placed along the medial axis of the major end. In three dimensions, the recess is a truncated cylinder, the truncation appearing where in body ends, in order to allow for the overhang of the coin, which allows the scraper to fulfill its desired propose. However, the recess cannot be configured so as to allow too much of the coin to overhang the major end, since the more the coin is exposed, the less holding area remains within the recess to grip the coin. For best results the plan view of the recess should form a circle with more than fifty percent and less than one hundred percent of its area located within the body.

Figure 3:
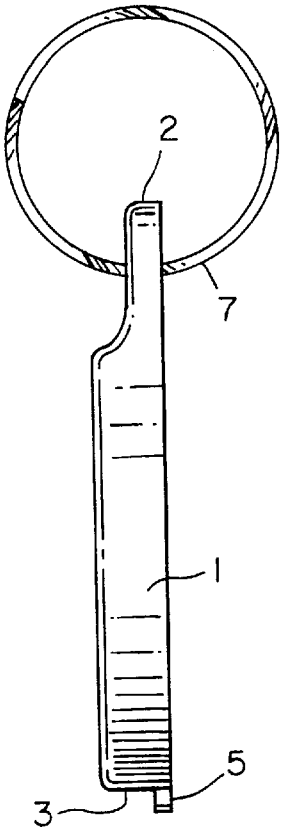
FIG. 3 depicts a side elevation view of the Scraper.

FIG. 3 depicts a side view elevation of the scraper. Referring to FIG. 3 it becomes apparent that the minor end is reduced in thickness relative to the major end. The reduction in the thickness of the minor end does not contribute to the scraping function of the scraper, but may aid in its use on a key ring. The reduction in the thickness of the minor end may reduce the size of the key ring with keys attached since the scraper will create less separation of the keys than it would if the minor end's thickness had not been reduced.

Figure 4:
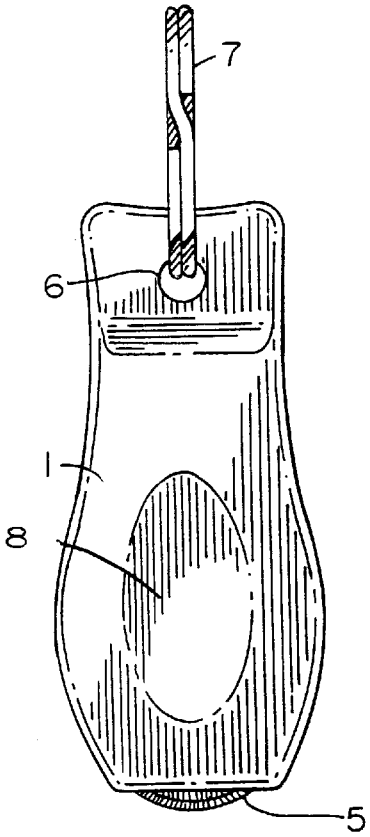
FIG. 4 depicts a bottom plan view of the Scraper.

FIG. 4 depicts a bottom plan view of the scraper. From this view a depression 8 can be seen in the middle of the major end. The depression, like the shape of the body, is an ergonomic design. The depression is located on the back of scraper so that, when in use, the thumb of the user is placed in the depression, the user's thumb is comfortable while exerting pressure sufficient to scrape the lottery ticket.

From the foregoing discussion it will be apparent that the scraper is ingenious in its simplicity. By implementing a coin into the scraper's design the manufacturer cuts production cost while at the same time making the scraper more appealing to customers, allowing them to use a coin to scrape their lottery tickets. Many people feel that coins bring them luck and luck is considered by many a major component of the lottery.

In an alternative embodiment the scraper is produced without the coin. The production and sales without a coin allows the consumer to use his or her own coin in the scraper, reducing the production costs could be cut even further. The scraper sold without a coin can be very appealing to people who have a lucky coin and would prefer to continue to use it. The scraper would allow them the comfort of the scraper with the luck of their favorite coin.

An additional hurdle that has been overcome with the new scraper is the problem of securing the coin in the scraper. Two possibilities are apparent upon inspection; is to glue the coin to the scraper, making a permanent attachment. The second is to manufacture the scraper with the recess slightly smaller than the proposed coin, and press-fitting the coin into the scraper. The press-fit approach allow the user to insert or remove coins of his own.

The scraper may be made from a variety of materials. Wood and plastic are cheap and easy to manufacture. Wood, however, is not sufficiently compliant to allow the coin to be press-fit into the recess. As a result, a wood scraper must be manufactured by gluing the coin into the recess.

Plastic may or may not allow press-fitting, depending upon the exact type of plastic used. Metal does generally have properties which allow press-fitting of the coin.

It will be apparent that improvements and modifications may be made within the purview of the invention without departing from the scope of the invention defined in the appended claims.

I claim:

1. A hand held device for scraping the surface layers from the face of a lottery ticket or the like comprising:

an elongated, unitary, modified-teardrop-shaped body having a major end and a minor end, wherein the major end has formed therein a recess in the form of a truncated cylinder into which a United States one-cent piece is inserted, and a square minor end containing a key-ring hole into which a key ring is inserted, said body comprised of a member of the group which consists of metal, plastic, and wood.

2. The hand held device of claim 1, wherein the body further comprises a top side and a bottom side, wherein the coin is attached to the bottom side, and wherein a depression is formed into the top side, so that the user may comfortably grip the device with his thumb in said depression.

3. A hand held device for scraping the surface layers from the face of a lottery ticket or the like comprising:

an elongated, unitary, modified-teardrop-shaped body having a major end and a minor end, wherein the major end has formed therein a recess in the form of a truncated cylinder, said recess of a size sufficient to contain a United States one-cent piece, and a square minor end containing a key-ring hole, into which a key ring is inserted, wherein said body is comprised of a member of the group which consists of metal, plastic, and wood.

4. The hand held device of claim 3, wherein the body farther comprises a top side and a bottom side, wherein the recess is attached to the bottom side, and wherein a depression is formed into the top side, so that the user may comfortably grip the device with his thumb in said depression.

* * * * *